United States Patent [19]

Jansz

[11] 4,064,702

[45] Dec. 27, 1977

[54] APPARATUS FOR MAINTAINING AXIAL ALIGNMENT BETWEEN A DROP HAMMER AND A DRIVEN PILE

[75] Inventor: Joost W. Jansz, The Hague, Netherlands

[73] Assignee: Hollandsche Beton Groep N. V., Rijswijk, Netherlands

[21] Appl. No.: 681,935

[22] Filed: Apr. 30, 1976

[30] Foreign Application Priority Data

Dec. 9, 1975 Netherlands ..... 7514331

[51] Int. Cl.[2] ..... E02D 7/00

[52] U.S. Cl. ..... 61/53.5; 61/53; 173/DIG. 1

[58] Field of Search ..... 61/53.5; 173/DIG. 1, 173/112, 1, 43; 175/6, 10, 220

[56] References Cited

U.S. PATENT DOCUMENTS

| | | | |
|---|---|---|---|
| 26,073 | 11/1859 | Whipple | 173/DIG. 1 |
| 1,598,439 | 8/1926 | Hansen | 173/DIG. 1 |
| 3,053,329 | 9/1962 | Fairchild | 173/112 X |
| 3,134,235 | 5/1964 | Parker et al. | 61/53.5 X |
| 3,345,879 | 10/1967 | Nasu et al. | 175/6 X |
| 3,869,003 | 3/1975 | Yamada et al. | 61/53.5 X |

FOREIGN PATENT DOCUMENTS

| | | | |
|---|---|---|---|
| 16,738 of | 8/1902 | United Kingdom | 61/53.5 |

*Primary Examiner*—Dennis L. Taylor
*Attorney, Agent, or Firm*—Sughrue, Rothwell, Mion, Zinn and Macpeak

[57] ABSTRACT

A submersible pile driving apparatus includes a drop hammer 7 reciprocably mounted in a guideframe on vertical posts 8. Either the drop hammer or the guideframe is guided on cables 4 secured to a crossbar 5 attached to the pile 6, and the guideframe is suspended from the surface ship by a rigid column of tube sections 10 or the like to which the guideframe has been rigidly connected. The apparatus is provided with a guide sleeve 12 or 13 having a funnel-shaped mouth to center the pile during descent. The overall arrangement maintains even very long piles in a vertical position during driving, and prevents tilting or tipping at the pile head - drop hammer interface.

3 Claims, 2 Drawing Figures

11
2
14
15
3
1
16
4
10
9
8
7
12
13
5
6

APPARATUS FOR MAINTAINING AXIAL ALIGNMENT BETWEEN A DROP HAMMER AND A DRIVEN PILE

BACKGROUND OF THE INVENTION

1. Field of the Invention

This invention relates to an apparatus for driving a pile into the soil at a considerable depth under water, and features a ship provided with means for mounting and lowering a pile to be driven into the soil or sea bed, as well as a drop-hammer, which can be lowered upon or with said pile.

2. Description of the Prior Art

A similar apparatus is known from the Dutch patent application No. 6808617, laid open for public inspection.

In the not pre-published Dutch patent application No. 7408710 corresponding to U.S. Ser. 588,554, the pile to be driven into the soil is suspended from cables and lowered together with the drop-hammer placed on it. As soon as pile and drop-hammer have reached the soil the driving can start. This is attended with impact-loads in the cables which keep the assembly of the pile and drop-hammer in an upright (vertical) position. To meet this problem it is proposed in Dutch patent application No. 7410905, which is an addition to patent application No. 7408710, to freely and movably guide the drop-hammer and the pile in a frame suspended from the hoisting means for the drop-hammer, which frame itself is guided upon cables from which the pile is suspended. When reaching the bottom the hoisting cable, which is coupled to the frame, is tensioned, after which the driving can start. This frame exerts a stabilizing effect upon the pile, which is necessary in the starting phase of the drive because the pile, which has not yet penetrated into the soil, tends to tip or overturn. This stabilizing effect is based on the fact that the pile and guide-frame tend to move in arcs of a circle, moving away from each other. As the upper end of the pile has been guided in the frame, such movement is not possible. If the upper end of the pile deviates from the vertical position then the frame must follow this deviation, but the frame resists such deviation because by means of its suspension it wants to maintain a vertical position. The correcting couple which is exerted is relatively small, and with piles of great length this solution cannot be used.

In Dutch patent application No. 7505975 it is proposed to lower the drop-hammer by cables after lowering the pile, with the aid of a guide-sleeve connected to the drop-hammer, enclosing the upper end of the pile, and guided cables which are tensioned between the vessel and a body lowered and resting upon the bottom of the sea.

SUMMARY OF THE INVENTION

The purpose of this invention is to provide an apparatus with which stability at great depths and with long piles can be achieved in a rather simple manner. According to the invention the drop-hammer is movably guided in the direction of the pile axis in a rigid frame, said frame rigidly being suspended from a bending-stiff hoisting means and said frame and/or drop-hammer being provided with a guide-sleeve which can be pushed or lowered over the upper end of the pile.

The invention makes use of a guide-frame which differs from that of Dutch patent application No. 7410905 in that the present frame has been rigidly mounted to a rigid hoisting means formed, for instance, by a string of pipes. Since the point of suspension of the guide-frame at the surface is a great distance away, the guide-frame acts as a rigid arm which offers resistance against changes of position of said frame and therewith of the pile.

DETAILED DESCRIPTION OF THE PREFERRED EMBODIMENTS

Figure 1:
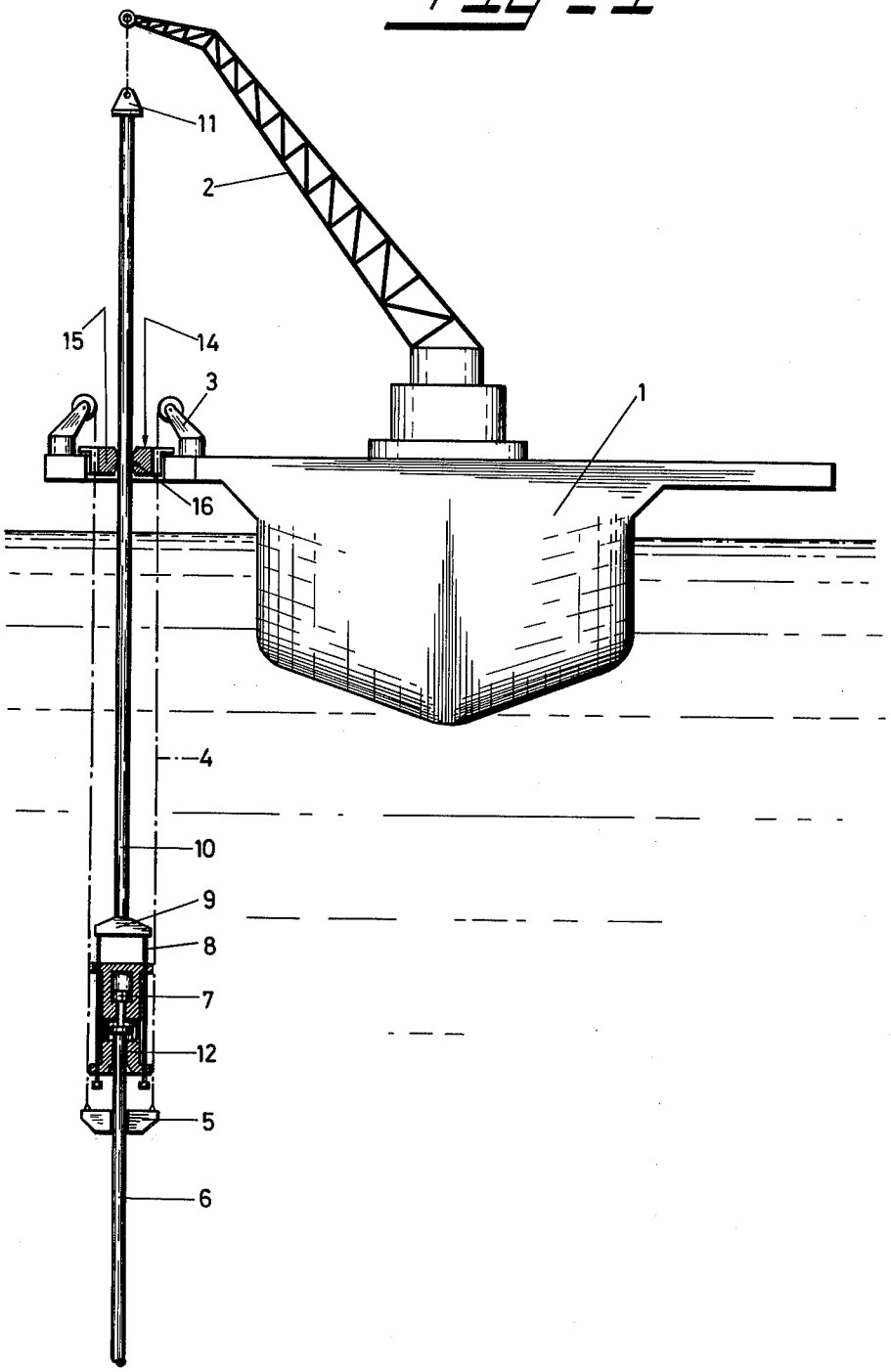
FIG. 1 shows a side view, in partial cross-section, of a first embodiment of the invention.

Both Figures show a vessel 1 with crane 2 and winches 3 of the type which can exert a constant tension. From these winches cables 4 run to a cross-bar 5 from which a pile 6 has been suspended. With both embodiments the drop-hammer 7 has mobably been guided upon the vertical posts 8 of a guide-frame. These vertical posts 8 are rigidly mounted to the upper part 9 of the guide-frame, which upper part in its turn is rigidly mounted to a string of pipes 10, carrying at the upper end an eye 11 with which the string is suspended from the hoisting cable of a crane 2.

In the embodiment of FIG. 1 the drop-hammer 7 is, in addition to being guided upon the posts 8, also guided at both its top and bottom upon the cables 4, said cables being connected to the crossbar 5 which carries the pile. Such further guiding may be implemented by cable slides, roller shoes, etc. as known in the art.

Figure 2:
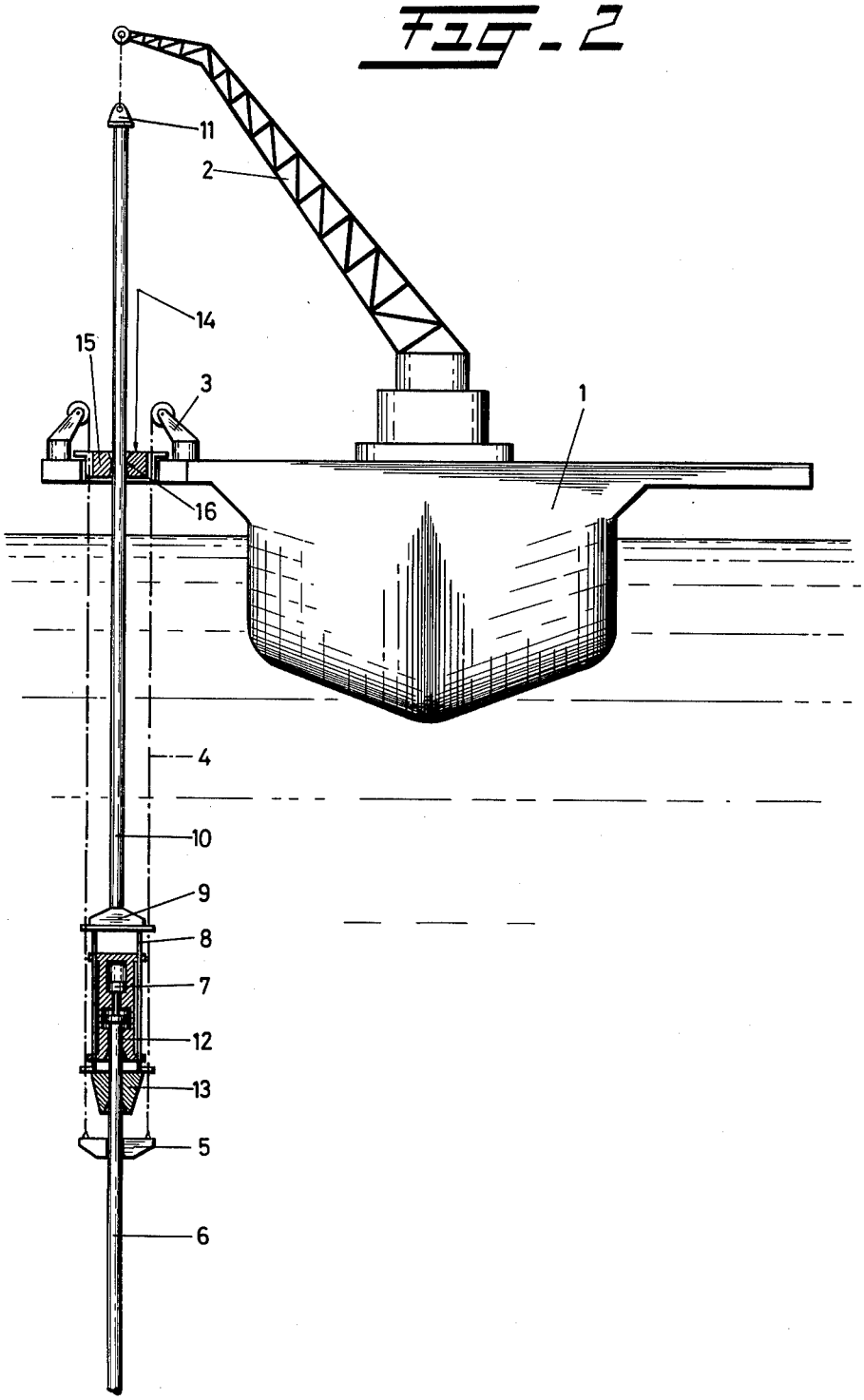
FIG. 2 shows a similar side view of a second embodiment of the invention.

In the embodiment of FIG. 2 the drop-hammer is guided in the frame on posts 8, and said frame itself is guided at its upper and lower ends upon the cables 4, said cables running to the crossbar 5, which has releasably been connected to the pile. With this embodiment the frame has been provided with a guide-sleeve 13, said sleeve being pushed over the upper end of the pile and holding the pile and frame in line with each other. If desired the drop-hammer 7 can be provided with a guide-sleeve 12, either alone, as shown in the embodiment of FIG. 1, or in combination with the guide-sleeve 13.

With both embodiments it is possible to lower drop-hammer, guide-frame and pile at the same time, or to lower first the pile and to then lower the guide-frame with the drop-hammer to the pile.

Instead of the string of pipes 10 it is also possible that the hoisting means consists of long frame-worked portions, for instance truss beams. By these means an open, light and yet rigid construction is possible. The string pipes 10 has been guided through an opening 14. This opening can also have the form of a groove, formed by two laterally extending portions of the hull of the vessel.

In order to obtain a hinging coupling of the string with the vessel it is possible to position supplementary pieces 15 in the opening 14 or in the groove, said pieces filling up said opening 14 and together forming the hinge-eye 16 whose walls are rounded off and have orifices for the ropes 4.

What is claimed is:

1. In an apparatus used in deep water pile driving having a pile lowered and driven into the seabed, the improvement comprising:

a. a rigid frame, b. a drop-hammer mounted on the frame for vertical reciprocating movement, c. rigid suspension means rigidly coupling the frame to hoisting means on a surface vessel and formed by a single member extending upwardly from the rigid frame, d. a guide sleeve on the lower end of the drop-hammer, said guide sleve having a funnel-shaped mouth opening to receive the fit over the head of a pile to be driven into the seabed, whereby the rigidity of the frame and suspension means and the insertion of the pile head within the guide sleeve combine to maintain the pile in a vertical position during driving and to resist any tipping or tilting at the pile head, drop-hammer interface, and e. a crossbar secured to the pile and cable means connecting the crossbar to winch means on the surface vessel, and means guiding the frame on the cable means.

2. An apparatus as in claim 1 further comprising an additional guide sleeve mounted on the lower end of the frame.

3. An apparatus as in claim 1 further comprising means guiding the drop-hammer on the cable means.

* * * * *